US011655607B2

(12) United States Patent
Robson

(10) Patent No.: US 11,655,607 B2
(45) Date of Patent: May 23, 2023

(54) SLAMMER

(71) Applicant: James Robson, Sharps Chapel, TN (US)

(72) Inventor: James Robson, Sharps Chapel, TN (US)

( * ) Notice: Subject to any disclaimer, the term of this patent is extended or adjusted under 35 U.S.C. 154(b) by 385 days.

(21) Appl. No.: 17/113,150

(22) Filed: Dec. 7, 2020

(65) Prior Publication Data

US 2021/0172147 A1 Jun. 10, 2021

Related U.S. Application Data

(60) Provisional application No. 62/944,499, filed on Dec. 6, 2019.

(51) Int. Cl.
*E02D 7/04* (2006.01)
*B25D 1/00* (2006.01)

(52) U.S. Cl.
CPC ..... *E02D 7/04* (2013.01); *B25D 1/00* (2013.01); *B25D 2222/21* (2013.01); *B25D 2250/391* (2013.01)

(58) Field of Classification Search
CPC ..... E02D 7/04; B25D 1/00
See application file for complete search history.

(56) References Cited

U.S. PATENT DOCUMENTS 3,992,021 A * 11/1976 Tobin ..... A63C 11/222 280/821
4,850,079 A * 7/1989 Thompson ..... B25D 1/00 30/232
6,386,418 B1 * 5/2002 Garner ..... B25C 5/025 227/156
2016/0089561 A1 * 3/2016 Oravecz ..... A63B 69/38 473/518

* cited by examiner

*Primary Examiner* — Nathaniel C Chukwurah
(74) *Attorney, Agent, or Firm* — Pitts & Lake, P.C.

(57) ABSTRACT

A hand-held driver device, comprising a solid impact body, configured to provide a user a surface for driving fasteners, an adjustable strap attached to a top surface of the solid impact body for retaining the solid impact body on the user's hand, a pair of inextensible rings attached to the adjustable strap, the pair of inextensible rings laterally opposed to each other and configured to provide a secure attachment point between the adjustable strap and the solid impact body, an adjustment device attached to the adjustable strap for modifying the length of the adjustable strap, an insulating surface integral to the top surface of the solid impact body, which is configured to conform to the shape of the user's hand and provide impact protection to the user's hand during use of the hand-held driver device, and a sacrificial bottom surface integral to the solid impact body, which is configured to make contact with the fasteners.

6 Claims, 2 Drawing Sheets

SLAMMER

CROSS-REFERENCE TO RELATED APPLICATIONS

This application claims the benefit of U.S. Provisional Patent Application No. 62/944,499, filed on Dec. 6, 2019.

FIELD OF INVENTION

The present general inventive concept relates to a hand-held tool for facilitating the installation of fasteners as used in landscaping and other applications.

BACKGROUND

Handle-held driver tools have been used in the construction and landscaping industry for many years to provide a tool for professionals or consumers to attach fasteners to surfaces, including attaching lawn staples. Some of these prior art devices include a tool glove having a striking surface and a hand-attached anvil. However, such approaches suffer from a lack of ease of use, difficulty and cost to manufacture, and a lack of adjustability.

Therefore, an easier, less expensive and more convenient approach to installing fasteners in multiple applications including in landscaping would be desirable.

BRIEF SUMMARY

According to various example embodiments of the present general inventive concept, a hand-held driver device is provided, comprising a solid impact body, configured to provide a user a surface for driving fasteners; an adjustable strap attached to a top surface of the solid impact body for retaining the solid impact body on the user's hand; a pair of inextensible rings attached to the adjustable strap, the pair of inextensible rings laterally opposed to each other and configured to provide a secure attachment point between the adjustable strap and the solid impact body; an adjustment device attached to the adjustable strap for modifying the length of the adjustable strap; an insulating surface integral to the top surface of the solid impact body, which is configured to conform to the shape of the user's hand and provide impact protection to the user's hand during use of the hand-held driver device; and a sacrificial bottom surface integral to the solid impact body, which is configured to make contact with the fasteners.

According to an alternative embodiment of the present general inventive concept, a hand-held driver device is provided, comprising a solid impact body, configured to provide a user a surface for driving fasteners; an adjustable strap attached to a top surface of the solid impact body for retaining the solid impact body on the user's hand; a pair of inextensible rings attached to the adjustable strap, the pair of inextensible rings laterally opposed to each other and configured to provide a secure attachment point between the adjustable strap and the solid impact body; an adjustment device attached to the adjustable strap for modifying the length of the adjustable strap; an insulating surface integral to the top surface of the solid impact body, which is configured to conform to the shape of the user's hand and provide impact protection to the user's hand during use of the hand-held driver device; and a sacrificial bottom surface which is integral to the solid impact body, and which is configured to make contact with the fasteners.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1:
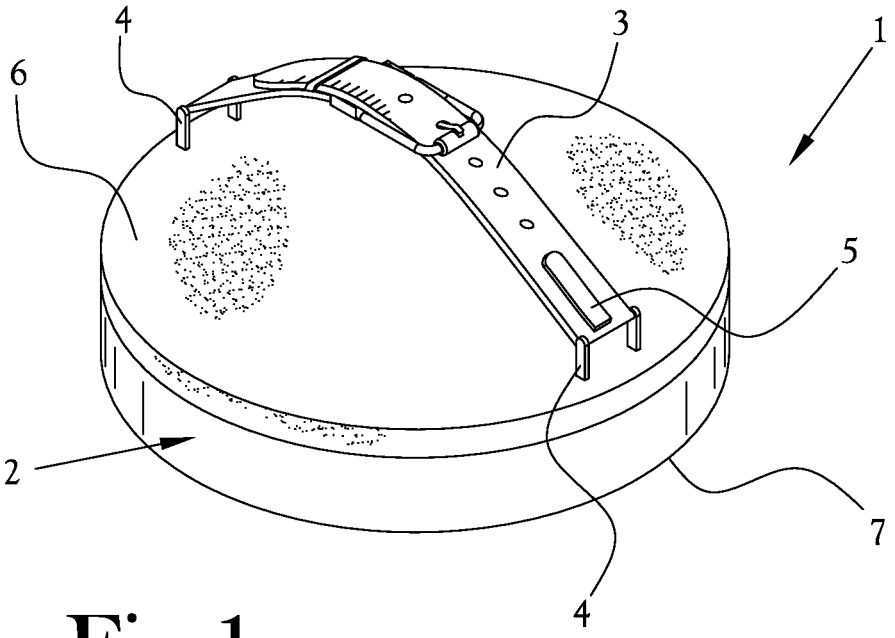
FIG. 1 is an image of the slammer according to example embodiments of the present general inventive concept.

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, a slammer device is provided that may be used to drive fasteners into a surface, including driving lawn staples in a lawn, for example to secure sod. Also part of the inventive concept of the slammer device is an adjustable strap for securing the user's hand to the slammer device. Moreover, it understood that various embodiments of the present general inventive concept may be used with other types of objects for attaching the slammer device to a user's hand, for example, a rope, a glove, etc.

In one embodiment, the slammer device contains a solid impact body, which includes a sacrificial bottom surface for impacting the fasteners, and driving them into a surface. This solid impact body may be made of metal, in various quantities, concrete, stone, or any number of solid and relatively dense surface for providing sufficient force and impact. In some embodiments, this solid impact body may be of a circular shape, generally conforming to the size of an adult hand.

The solid impact body may consist of one material, or it may be made in layers from different materials, for example, to reduce the costs of manufacture. For example, the majority of the solid impact body may be made from wood, with a metal layer for the sacrificial bottom surface of the solid impact body, which is used to come in contact with the fastener. The sacrificial bottom surface may utilize a waffle-shaped head, configured to provide a non-slip surface, when, for example, the slammer device is used in the rain or snow. Additionally, the top surface of the solid impact body may consist of an insulating and impact-resistant layer, which comes in contact with the user's hand. Such a layer may be made from gel, rubber, plastic, or many other materials known in the art to absorb the impact of the solid impact body.

To secure the solid impact body to the user's hand, an adjustable strap or other device may be provided. In one embodiment, this may consist of a canvas strap, or other resilient material. Although the adjustable strap may consist of a single section, in some embodiments, the adjustable strap consists of two sections, and an adjustment device attached thereto, which allows the user to obtain a precise fit of the slammer device on their hand. This adjustment device may be a metal belt buckle attached to one section of the adjustable strap with holes in the other section, or a Velcro hook and loop fastener, with the hook portion attached to one section and the loop attached to the second section. Other attachment methods are known in the art. Additionally, a metal clip may be attached to the adjustable strap to provide a method of attaching the slammer device to the user's belt, pants, or other articles of clothing when the slammer device is not in use.

In some embodiments of the present general inventive concept, a pair of solid and inextensible rings may be attached to the adjustable strap. These inextensible rings may be used to provide a secure attachment point to connect the adjustable strap to the solid impact body. These inextensible rings may be made of metal, or other materials known in the art, and may be inserted through openings in both the adjustable strap and the solid impact body. The inextensible rings will generally be on laterally opposed sides of the solid impact body in order to provide the user a secure grip of the solid impact body while driving in fasteners.

The method of use of the slammer may consist of the following steps. Prior to beginning using the slammer, the user may first attach the solid impact body onto their hand to determine a proper fit. If the fit is too tight or too loose, it may be adjusted by either tightening or loosening the adjustable strap using the adjustment device. Once the proper fit has been obtained, the user may proceed with the use of the slammer in driving fasteners, including landscape staples, into a surface by impacting the fastener with the sacrificial bottom surface of the solid impact body.

FIG. 1 shows an example embodiment of the present general inventive concept. A perspective view of the slammer device 1 is provided showing the top surface of the solid impact body 2. In this view, the adjustable strap 3 comprises a watch band or belt type strap, although other attachment devices known in the art may be used. Inextensible rings 4 are shown which are configured to secure the adjustable strap 3 to the solid impact body 2. Another type of adjustment device such as a metal belt buckle may be used to adjust the fit of the slammer 1 to the user's hand, as is described above. Additionally, a metal clip 5 as shown may be attached to the adjustable strap 3 to provide a method of attaching the slammer device 1 to the user's belt, pants, or other articles of clothing when not using the slammer device 1.

Figure 2:
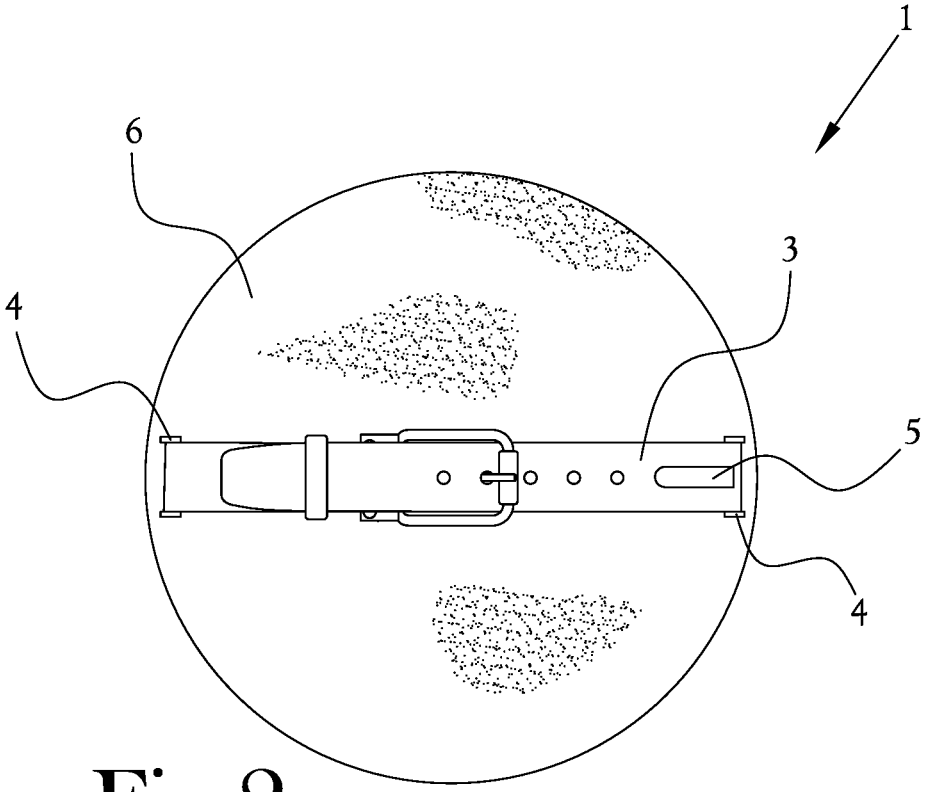
FIG. 2 is an alternative image of the slammer according to example embodiments of the present general inventive concept.

FIG. 2 shows a top view of the slammer device 1. As in the previous view, an adjustable strap 3 may comprise a watch band or belt type strap, although other attachment devices known in the art may be used. The top surface of the solid impact body 2, as shown, may have an insulating and impact-resistant layer 6, which comes in contact with the user's hand. Such a layer may be made from gel, rubber, plastic, or many other materials known in the art. In this view, the solid impact body 2 is assuming a circular shape, although other shapes may also be used, including square shape, oval, and hand-shaped.

Figure 3:
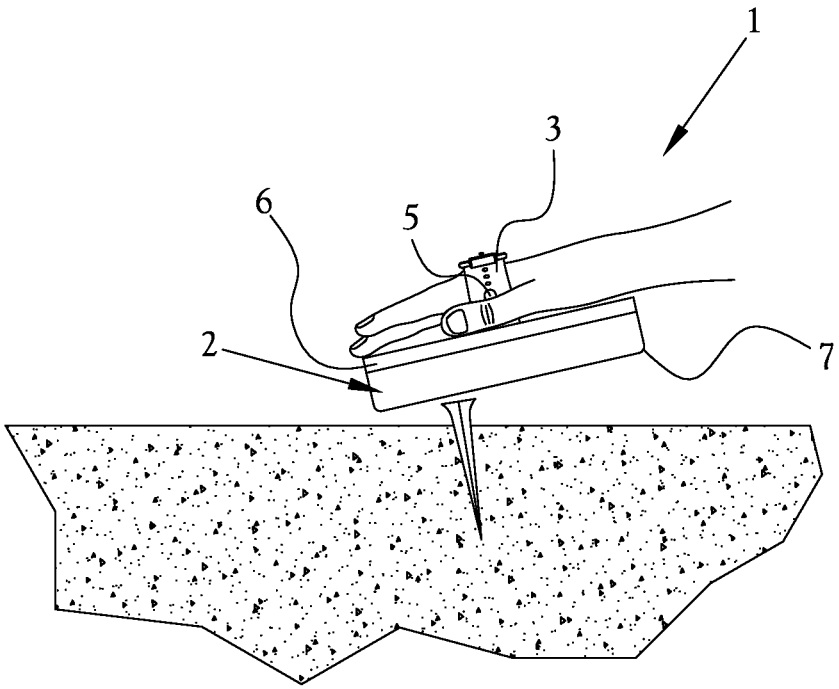
FIG. 3 is an alternative image of the slammer according to example embodiments of the present general inventive concept.

FIG. 3 is a side view of the slammer device 1. This image shows the adjustable strap 3 which may generally conform to the size and shape of the user's hand. Additionally, a view of the inextensible rings 4 is provided. The diameter of the solid impact body 2 is given as 6". Although in some embodiments the slammer device 1 is generally the size of a human hand, no particular dimension is required. Finally, the sacrificial bottom surface 7 of the solid impact body 2 may be fabricated with a waffle head type configuration, which will provide a non-slip type surface for driving in fasteners, for example, when the slammer device 1 is being used in rainy conditions.

Additional features and embodiments of the present general inventive concept will be readily apparent to those skilled in the art upon review of the present disclosure, and describe some, but not all, possible embodiments of the present inventive concept. Various additional components and features could be chosen using sound engineering judgement to achieve the same or similar results.

The invention claimed is:

1. A hand-held driver device, comprising:

a solid impact body, configured to provide a user a surface for driving fasteners;

an adjustable strap attached to a top surface of the solid impact body for retaining the solid impact body on the user's hand;

a pair of inextensible rings attached to the adjustable strap, the pair of inextensible rings laterally opposed to each other and configured to provide a secure attachment point between the adjustable strap and the solid impact body;

an adjustment device attached to the adjustable strap for modifying the length of the adjustable strap;

an insulating surface integral to the top surface of the solid impact body, which is configured to conform to the shape of the user's hand and provide impact protection to the user's hand during use of the hand-held driver device; and a sacrificial bottom surface integral to the solid impact body, which is configured to make contact with the fasteners.

2. The device of claim 1, wherein the insulating surface comprises a gel material.

3. The device of claim 2, wherein the adjustable strap comprises two separate sections.

4. The device of claim 3, wherein the adjustable strap includes a metal clip configured to be attached to the user's belt or clothing.

5. The device of claim 4, wherein the solid impact body includes twenty ounces of metal.

6. The device of claim 3, wherein the adjustment device comprises a hook and loop closure interface and wherein the hook is attached to one section and the loop is attached to the second section.

* * * * *